US006252965B1

(12) United States Patent
Beard

(10) Patent No.: US 6,252,965 B1
(45) Date of Patent: Jun. 26, 2001

(54) MULTICHANNEL SPECTRAL MAPPING AUDIO APPARATUS AND METHOD

(76) Inventor: Terry D. Beard, 1407 N. View Dr., Westlake Village, CA (US) 91362

( * ) Notice: Subject to any disclaimer, the term of this patent is extended or adjusted under 35 U.S.C. 154(b) by 0 days.

(21) Appl. No.: 08/715,085

(22) Filed: Sep. 19, 1996

(51) Int. Cl.[7] ..... H04R 5/00
(52) U.S. Cl. ..... 381/23; 381/19
(58) Field of Search ..... 381/63, 2, 1, 17, 381/18, 310, 19, 20, 21, 22, 23

(56) References Cited

U.S. PATENT DOCUMENTS

| | | | | |
|---|---|---|---|---|
| 3,746,792 | | 7/1973 | Scheiber . | |
| 3,959,590 | | 5/1976 | Scheiber . | |
| 4,449,229 | * | 5/1984 | Mori | 381/2 |
| 4,803,727 | * | 2/1989 | Holt et al. | 381/2 |
| 4,815,132 | * | 3/1989 | Minami | 381/1 |
| 5,136,656 | | 8/1992 | Griesinger | 381/22 |
| 5,285,498 | * | 2/1994 | Johnston | 381/2 |
| 5,319,713 | | 6/1994 | Waller, Jr. | 381/22 |
| 5,333,201 | | 7/1994 | Waller, Jr. | 381/22 |
| 5,381,482 | * | 1/1995 | Matsumoto et al. | 381/18 |
| 5,459,790 | | 10/1995 | Scofield et al. . | |
| 5,524,054 | | 6/1996 | Spille | 381/20 |
| 5,579,124 | | 11/1996 | Aijala et al. | 386/96 |
| 5,632,005 | | 5/1997 | Davis et al. | 704/504 |
| 5,638,451 | | 6/1997 | Sedlmeyer | 381/2 |
| 5,930,733 | | 7/1999 | Park et al. | 702/76 |

OTHER PUBLICATIONS

Dressler, "Dolby Pro Logic Surround Decoder Principles of Operation", http://www.dolby.com/ht/ds&pl/whtppr.html, pp. 1–13.

Waller, Jr., "The Circle of Surround® Audio Surround System", Rocktron Corporation White Paper, pp. 1–7.

O'Shaughnessy, "Speech Communication—Human and Machine", Addison–Wesley Publishing Company, 1987, pp. 148–153.

* cited by examiner

*Primary Examiner*—Forester W. Isen
*Assistant Examiner*—Brian T. Pendleton
(74) *Attorney, Agent, or Firm*—Koppel & Jacobs

(57) ABSTRACT

A method and circuit for deriving a set of multichannel audio signals from a conventional monaural or stereo audio signal uses an auxiliary multichannel spectral mapping data stream. Audio can be played back in stereo and multichannel formats from a conventional stereo signal on compact discs, FM radio, or other stereo or monaural delivery systems. The invention reduces the data rate needed for the transmission of multichannel digital audio.

97 Claims, 6 Drawing Sheets

MULTICHANNEL SPECTRAL MAPPING AUDIO APPARATUS AND METHOD

BACKGROUND OF THE INVENTION

1. Field of the Invention

This invention relates to multichannel audio systems and methods, and more particularly to an apparatus and method for deriving multichannel audio signals from a monaural or stereo audio signal.

2. Description of the Related Art

Monaural sound was the original audio recording and playback method invented by Edison in 1877. This method was subsequently replaced by stereo or two channel recording and playback, which has become the standard audio presentation format. Stereo provided a broader canvas on which to paint an audio experience. Now it has been recognized that audio presentation in more than two channels can provide an even broader canvas for painting audio experiences. The exploitation of multichannel presentation has taken two routes. The most direct and obvious has been to simply provide more record and playback channels directly; the other has been to provide various matrix methods which create multiple channels, usually from a stereo (two channel) recording. The first method requires more recording channels and hence bandwidth or storage capacity. This is generally not available because of intrinsic bandwidth or data rate limitations of existing distribution means. For digital audio representations, data compression methods can reduce the amount of data required to represent audio signals and hence make it more practical, but these methods are incompatible with normal stereo presentation and current hardware and software formats.

Matrix methods are described in Dressler, "Dolby Pro Logic Surround Decoder—Principles of Operation" (http://www.dolby.com/ht/ds&pl/whtppr.html); Waller, Jr., "The Circle Surround® Audio Surround Systems", Rocktron Corp. White Paper; and in U.S. Pat. Nos. 3,746,792, 3,959,590, 5,319,713 and 5,333,201. While matrix methods are reasonably compatible with existing stereo hardware and software, they compromise the performance of the stereo or multichannel presentations, or both, their multichannel performance is severely limited compared to a true discrete multichannel presentation, and the matrixing is generally uncontrolled.

SUMMARY OF THE INVENTION

The present invention addresses these shortcomings with a method and apparatus which provide an uncompromised stereo presentation as well as a controlled multichannel presentation in a single compatible signal. The invention can be used to provide a multichannel presentation from a monaural recording, and includes a spectral mapping technique that reduces the data rates needed for multichannel audio recording and transmission.

These advantages are achieved by sending along with a normally presented "carrier" audio signal, such as a normal stereo signal, a spectral mapping data stream. The data stream comprises time varying coefficients which direct the spectral components of the "carrier" audio signal or signals to multichannel outputs.

During multichannel playback, the invention preferably first decomposes the input audio signal into a set of spectral band components. The spectral decomposition may be the format in which the signals are actually recorded or transmitted for some digital audio compression methods and for systems designed specifically to utilize this invention. An additional separate data stream is sent along with the audio data, consisting of a set of coefficients which are used to direct energy from each spectral band of the input signal or signals to the corresponding spectral bands of each of the output channels. The data stream is carried in the lower order bits of the digital input audio signal, which has enough bits that the use of lower order bits for the data stream does not noticeably affect the audio quality. The time varying coefficients are independent of the input audio signal, since they are defined in the encoding process. The "carrier" signal is thus substantially unaffected by the process, yet the multichannel distribution of the signal is under the complete control of the encoder via the spectral mapping data stream. The coefficients can be represented by vectors whose amplitudes and orientations define the allocation of the input audio signal among the multiple output channels.

DETAILED DESCRIPTION OF THE INVENTION

Figure 1:
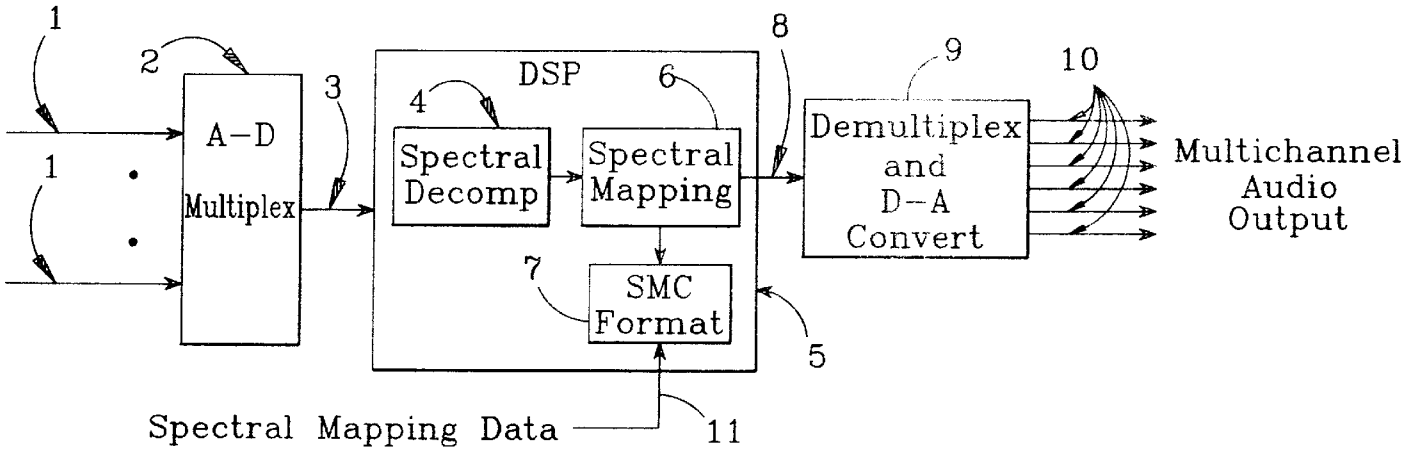
FIG. 1 is a block diagram of a digital signal processor (DSP) implementation of the invention's multichannel spectral mapping (MSM) decoder.

A simplified functional block diagram of a DSP implementation of a decoder that can be used by the invention is shown in FIG. 1. A "carrier" audio signal, which may be monaural or stereo for example, is input to an analog-to-digital (A-D) converter and multiplexer 2 via input lines 1. For simplicity the singular term "signal" is used to include a composite of multiple input signals. In some applications the audio signal will already be in a multiplexed digital (PCM) representation and the A-D multiplexer will not be needed. The digital output of the A-D multiplexer is passed via line 3 to the DSP 5, where the signal is broken into a set of spectral bands in the spectral decomposition algorithm 4, and sent to a spectral mapping function algorithm 6. The spectral bands are preferably the conventional critical (bark) bands, which have a roughly constant bandwidth of about 100 Hz for frequencies below 500 Hz, and a bandwidth that increases with frequency for higher frequencies (roughly logarithmically above 1 kHz). Critical bands are discussed in O'Shaughnessy, *Speech Communication— Human and Machine*, Addison-Wesley, 1987, pages 148–153.

The spectral mapping function algorithm 6 directs the input signals in each of the bands from each of the input channels to corresponding bands of each of the output channels as directed by spectral mapping coefficients (SMCs) delivered from a spectral mapping coefficient formatter 7. The SMC data is input to the DSP 5 via a separate input 11. The multiplexed resultant digital audio output signals are passed over a line 8 to a demultiplexer digital-to-analog (D-A) converter 9, where they are converted into multichannel analog audio outputs applied to output lines 10, one for each channel.

The input signals can be broken into spectral bands in the spectral decomposition algorithm by any of a number of well know methods. One method is by a simple discrete Fourier transform. Efficient algorithms for performing the discrete Fourier transform are well known, and the decomposition is in a form readily useable for this invention. However, other common spectral decomposition methods such as multiband digital filter banks may also be used. In the case of the discrete Fourier transform decomposition, some transform components may be grouped together and controlled by a single SMC so that the number of spectral bands utilized by the invention need not equal the number of components in the discrete Fourier transform representation or other base spectral representation.

Figure 2:
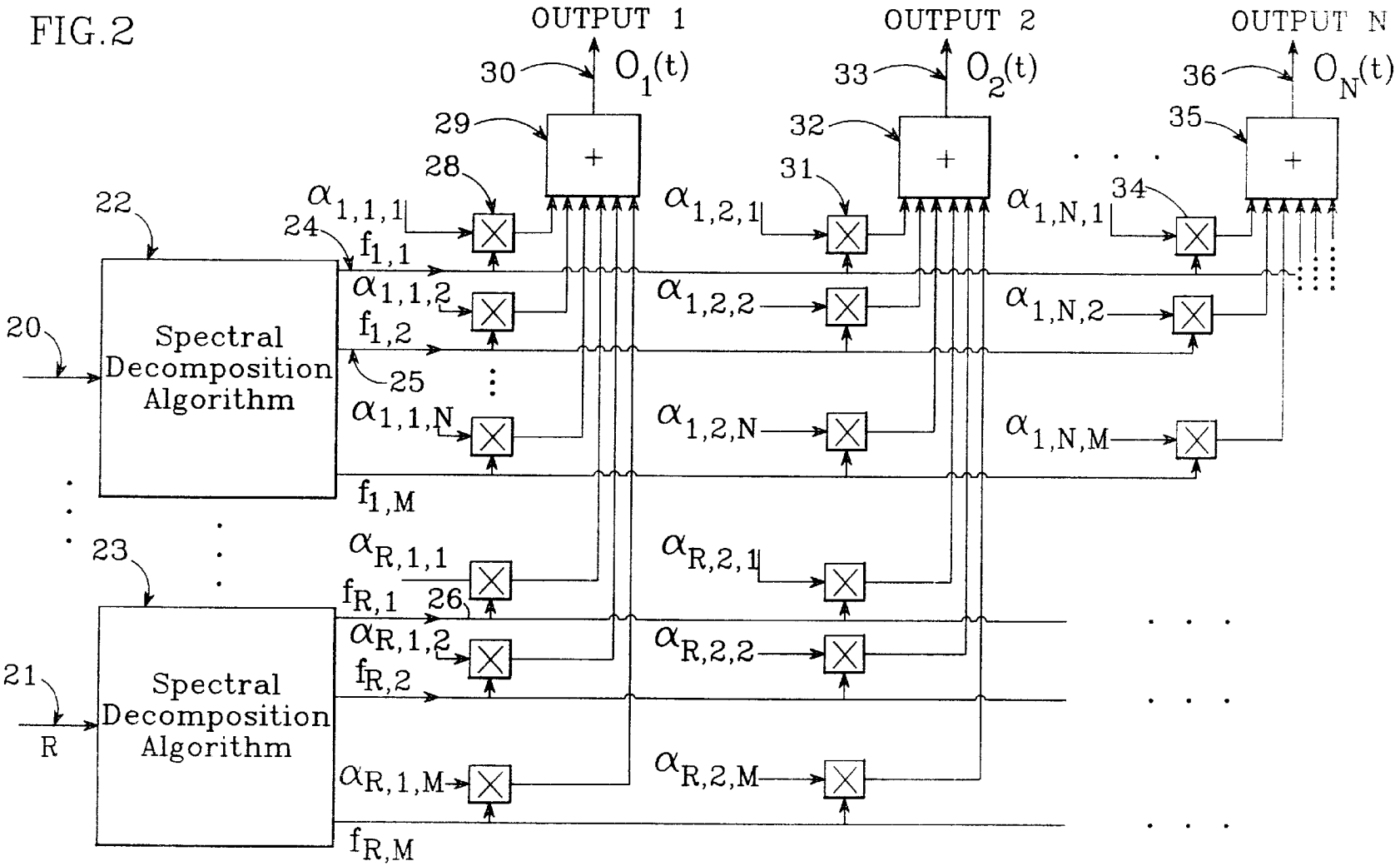
FIG. 2 is a block diagram illustrating the DSP multichannel spectral mapping algorithm structure.

A more detailed block diagram of the DSP multichannel spectral mapping algorithm 6, along with the spectral decomposition algorithm 4, is shown in FIG. 2. The signal "lines" in the drawing indicate information paths in the implementing DSP algorithm, while the multiply and sum function blocks indicate operations in the DSP algorithm that implement the spectral mapping aspect of the invention. This functional block diagram is shown only to describe the DSP implementation algorithm. Although the invention could in principle be implemented with separate multiply and add components as indicated in the drawing, that is not the intent implied by this explanatory figure.

Respective spectral decomposition algorithms 22 and 23 are provided for each input channel. For a standard stereo input consisting of left and right input signals respectively on input lines 20 and 21, left and right algorithms are provided; there is only one algorithm for a monaural input. Each spectral decomposition algorithm produces inputs to the spectral mapping algorithm within M spectral bands on corresponding lines 24, 25 . . . for algorithm 22, and lines 26 . . . for algorithm 23. The algorithms preferably operate on a multiplexed basis in synchronism with the multiplexed output of multiplexer 2 in FIG. 1, but are shown in FIG. 2 as separate blocks for ease of understanding.

The input frequency bands produced by the spectral decomposition algorithms are designated by the letter F followed by two subscripts, with the first subscript standing for the input channel and the second subscript for the frequency band within that channel. A separate SMC, designated by the letter $\alpha$, is provided for each frequency band of each input channel for mapping onto each output channel, with the first subscript after $\alpha$ indicating the corresponding input source channel, the second subscript the output target channel, and the third subscript the frequency band. The input frequency band F1,1 on line 24 is multiplied in multiplier 28 by a SMC $\alpha_{1,1,1}$ from the spectral mapping coefficient formatting algorithm 7 of FIG. 1, and passed to a summer 29 for the first output channel, where it is accumulated with the products of all the other input frequency bands multiplied by their respective SMCs for the first output channel. Specifically, the other input components F1,2 . . . F1,M . . . FR,1 FR,2 . . . FR,M (for R input channels) are multiplied by their respective SMCs $\alpha_{1,1,2} \ldots \alpha_{1,1,M} \ldots \alpha_{R,1,1}, \alpha_{R,1,2} \ldots \alpha_{R,1,M}$ to produce a first channel output 30. This process is duplicated for all spectral bands of all input and output channels as indicated in the figure, in which the multipliers, summer and output for output channel 2 are respectively indicated by reference numbers 31, 32 and 33, and the multipliers, summer and output for output channel N are respectively indicated by 34, 35 and 36.

From FIG. 2 the multichannel output signals are given by the following equations:

$$O_K(t) = \sum_T \sum_{J=1}^{R} \sum_{L=1}^{M} \alpha_{J,K,L,T} \times F_{J,L,T}(t)$$

where:

$O_K(t)$=the output of channel K at time t.

$\alpha_{J,K,L,T}$=the SMC of input channel J's Lth spectral band component in time aperture period T onto output channel K.

$F_{J,L,T}(t)$=The Jth input channel's Lth spectral band signal at time t from aperture window T.

There are R input channels, M spectral bands in the decomposition of each input signal and N output channels. In the example given, at any particular time t there will be contributions to the output signal from components from one or two overlapping transform windows. T is the subscript indicating a particular transform window. The multiply and add operations described in the invention can be carried out on one of more DSPs, such as a Motorola 56000 series DSP.

In some applications, particularly those in which the input digital audio signal has been digitally compressed, the signal may be delivered to the playback system in a spectrally decomposed form and can be applied directly to the spectral mapping subsystem of the invention with simple grouping into appropriate bands. A good spectral decomposition is one that matches the spectral masking properties of the human hearing system like the so called "critical band" or "bark" band decomposition. The duration of the weighing function, and hence the update rate of the SMCs, should accommodate the temporal masking behavior of human hearing. A standard 24 "critical band" decomposition with 5–20 millisecond SMC update is very effective in the present invention. Fewer bands and a slower SMC update rate is still very effective when lower rates of spectral mapping data are required. Update rates can be as slow as 0.1 to 0.2 seconds, or even constant SCMs can be used.

Figure 3:
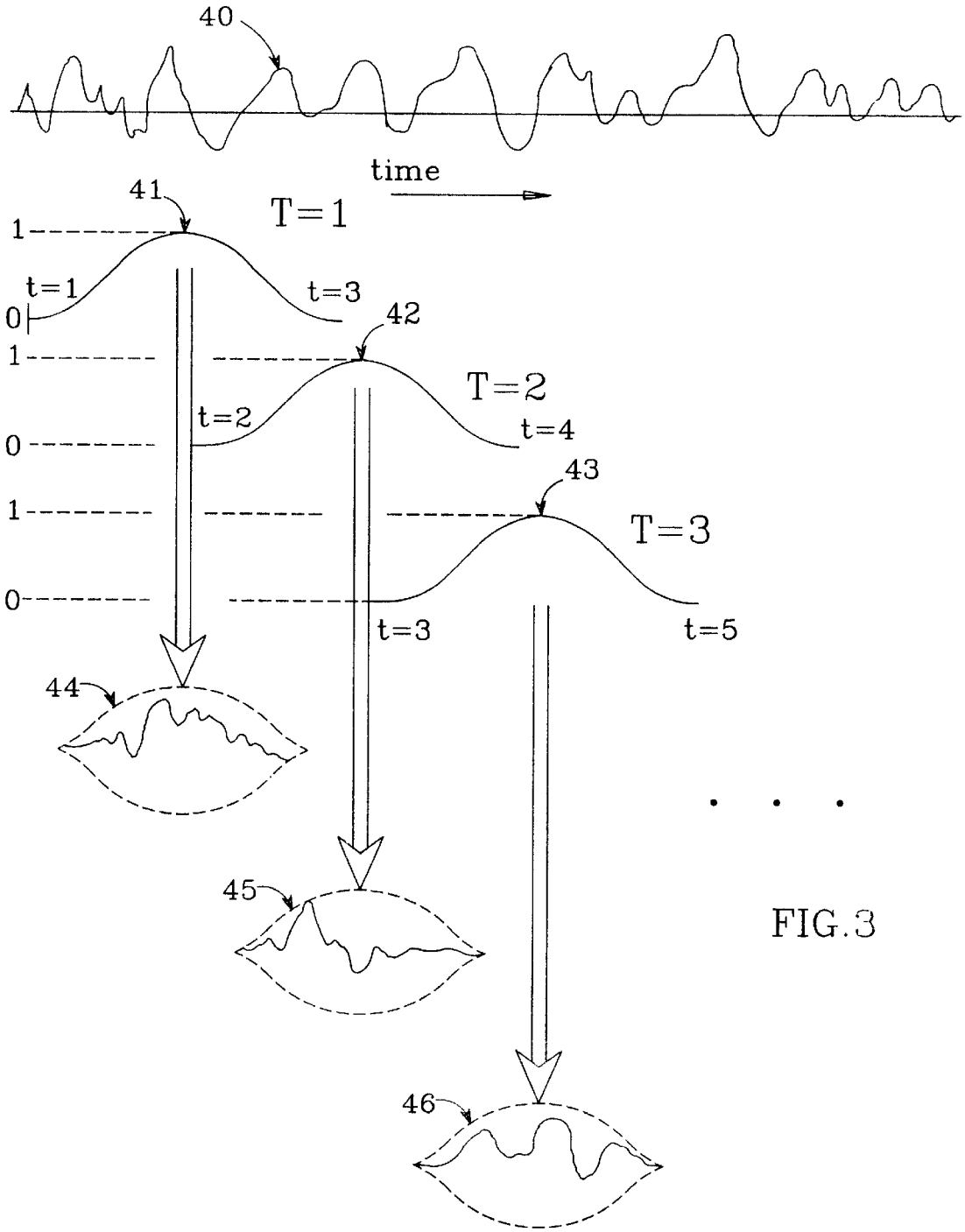
FIG. 3 is a set of signal waveforms illustrating the use of aperture functions to obtain discrete transform representations of continuous signals.

FIG. 3 illustrates the role of temporal aperture functions in the spectral decomposition of an audio signal and the relationship of the decomposition to the SMCs illustrated in FIGS. 1 and 2. An audio signal 40 is multiplied by generally bell curve shaped aperture functions 41, 42, 43 . . . to produce the bounded signal packets 44, 45, 46 . . . before performing the discrete Fourier transform on the resultant "apertured" packets. The aperture function 41 increases from zero at a time t=1 to unity and then back to zero over a period T that ends at time t=3. Aperture functions 42 and 43 have similar shapes, with function 42 spanning a second period T between t=2 and t=4, and function 43 spanning a third period T between t=3 and t=5. Each successive aperture function preferably begins at the midpoint of the immediately preceding aperture period. This process provides for artifact free recomposition of the signal from the resultant multiple transform representation and provides a natural time frame for the SMCs. Aperturing is the standard signal processing technique used in the discrete spectral transformation of continuous signals.

A set of SMCs can be provided for each transformed signal packet such as 44. These coefficients describe how much of each spectral component in the signal packet is directed to each of the output signal channels for that aperture period. In FIG. 2 the input signal is shown decomposed into frequency bands F1, F2, . . . , FM. The SMC is the fraction of the signal level in band L directed from the input J to output K for aperture period T. A complete set of coefficients define the distribution of the signals in all the spectral bands in a given T aperture period. A new set of SMCs are provided for the next overlapping aperture period, and so on. The total signal at any point in time on a given output channel will thus be the sum of the SMCs directing signal components from the overlapping spectral decompositions periods of the input "carrier" signal or signals.

The signal level in each frequency band ultimately represents the signal energy in that band. The energy level can be expressed in several different ways. The energy level can be used directly, or the signal amplitude of the Fourier transform can be used, with or without the phase component (energy is proportional to the square of the transform amplitude). The sine or cosine of the transform could also be used, but this is not preferred because of the possibility of dividing by zero when the transform is non-zero.

The frequency bands of the spectral decomposition of the signal are best selected to be compatible with the spectral and temporal masking characteristics of human hearing, as mentioned above. This can be achieved by appropriate grouping of discrete Fourier spectral components in "critical band"-like groups and using a single SMC control of all components grouped in a single band. Alternatively, conventional multiband digital filters may be used to perform the same function. The temporal resolution or update rate of the SMCs is ultimately limited to multiples of the time between the transform aperture functions illustrated in FIG. 3. For example, if the interval between time 1 and time 3 comprises 1000 PCM samples, providing a 1000 point discrete Fourier transform, the minimum time between updates of SMCs would be one-half that period or 500 PCM samples. In the case of a conventional digital audio sample rate of 48,000 samples per second, this is a period of 10.4 milliseconds.

Figure 4:
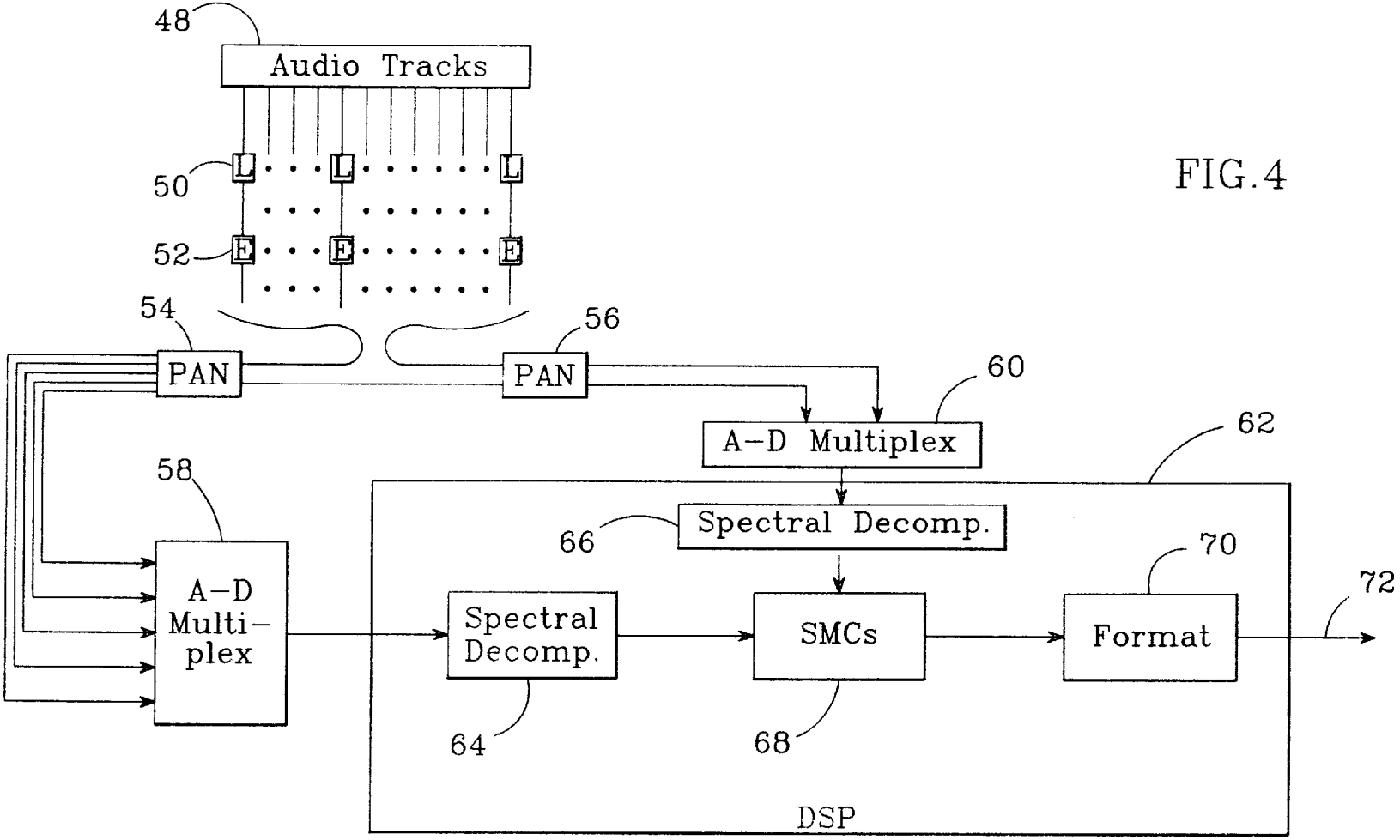
FIG. 4 is a block diagram of a DSP implementation of a method for calculating the spectral mapping coefficients in the encoding process.

One method for generating the SMCs in the encoding process is shown in the DSP algorithm functional block diagram of FIG. 4. Once generated, the SMCs are carried along with the standard stereo (or monaural) digital audio signal in the desired medium, such as a compact disk, tape or radio broadcast, formatted by the SMC formatting algorithm 6 at the player or receiver, and used to control the mapping of the original stereo or monaural signal onto the multitrack output from the decoder DSP 6.

An important feature of the invention relates to how the SMCs are generated in a conventional sound mixing process. One implementation proceeds as follows. Given the same master source material used to produce the basic stereo or mono "carrier" recording, which is usually a multitrack source 48 of 24 or more tracks, one produces a second "guide" mix in the desired multichannel output format. Separate level adjustors 50 and equalizers 52 are provided for each track. During the multichannel "guide" mix, the level and equalization of the master source tracks are maintained the same as in the stereo mix, but are panned or "positioned" to produce the desired multichannel mix using a multichannel panner 54 which directs different amounts of the source tracks to different "guide" or target channels (five guide channels are illustrated in FIG. 4). A separate panner 56 distributes the level adjusted and equalized track signals among the "carrier" or input source channels (stereo carrier channels are illustrated in FIG. 4).

The SMCs are derived by spectrally decomposing both the stereo carrier signals and the multichannel guide signals, and calculating the ratios of the signals in each output channel's spectral bands compared to the signal in the corresponding input "carrier" spectral bands. This procedure assures that the spectral makeup of the output channels corresponds to that of the "guide" multichannel mix. The calculated ratios are the SMCs required to attain this desired result. The SMC derivation algorithm can be implemented on a standard DSP platform.

The "guide" multichannel mix is delivered from panner 54 to an A-D multiplexer 58, and acts as a guide for determining the SMCs in the encoding process. The encoder determines the SMCs that will match the spectral content of the decoder's multichannel output to the spectral content of the multichannel "guide" mix. The "carrier" audio signal is input from panner 56 to an A-D multiplexer 60. The digital outputs from A-D multiplexers 58 and 60 are input to a DSP 62. Rather than the two A-D multiplexers shown for functional illustration, a single A-D multiplexer is generally used to convert and multiplex all "carrier" and "guide" signals into a single data stream to the DSP. The "carrier" and "guide" functions are shown separately in the figure for clarity of explanation.

The "guide" and "carrier" digital audio signals are broken into the same spectral bands as described above for the decoder by respective spectral decomposition algorithms 64 and 66. The level of the signal in each band of each input multichannel "guide" signal is divided by the level of each of the signals in the corresponding band of the "carrier" signal by a spectral band level ratio algorithm 68 to determine the value of the corresponding SMC. For example, the ratio of the signal level in band 6 of target channel 3 to the signal level of band 6 of carrier input channel 2 is SMC 2,3,6. Thus, if there are five channels in the "guide" multichannel mix and two channels (stereo) in the "carrier" mix, and the signals are each broken into ten spectral bands, a total of 100 SMCs would be calculated for each transform or aperture period. The calculated coefficients are formatted by an SMC formatter 70 and output on line 72 as the spectral mapping data stream used by the decoder.

The SMCs generated using the above method may be used directly in implementing the invention or they may be modified using various software authoring tools, in which case they can serve as a starting or first approximation of the final SMC data.

Alternatively, entirely new sets of coefficients may be produced to effect any desired multichannel distribution of the "carrier" signal. For example, any input signal can be directed to any output channel by simply setting all SMCs for that input to that output to 1 and all SMCs for that input to other channels to 0. Another feature which the SMCs may have is an added time or phase delay component to provide an added dimension of control in the multichannel output configuration derived from the "carrier" signal.

Conventional stereo matrix encoding can also be used in conjunction with the current invention to enhance the multichannel presentation obtained using the method. To do this the phases of the spectral band audio components of the "carrier" audio can be manipulated in the recording process to increase the separation and discreetness of the final multichannel output. In some cases this can reduce the amount of SMC data required to attain a given level of performance.

The coefficients in the SMC matrix need not be updated for every new transform period, and some of the coefficients may be set to always be 0. For example, the system may arbitrarily not allow signal from a left stereo input to appear on the right multichannel output, or the required rate of change of the low frequency band SMCs may not need to be as high as the rate for the upper frequency bands. Such restrictions can be used to reduce the amount of information required to be transmitted in the SMC data stream. In addition, other conventional data reduction methods may also be used to reduce the amount of data needed to represent the SMC data.

Figure 5:
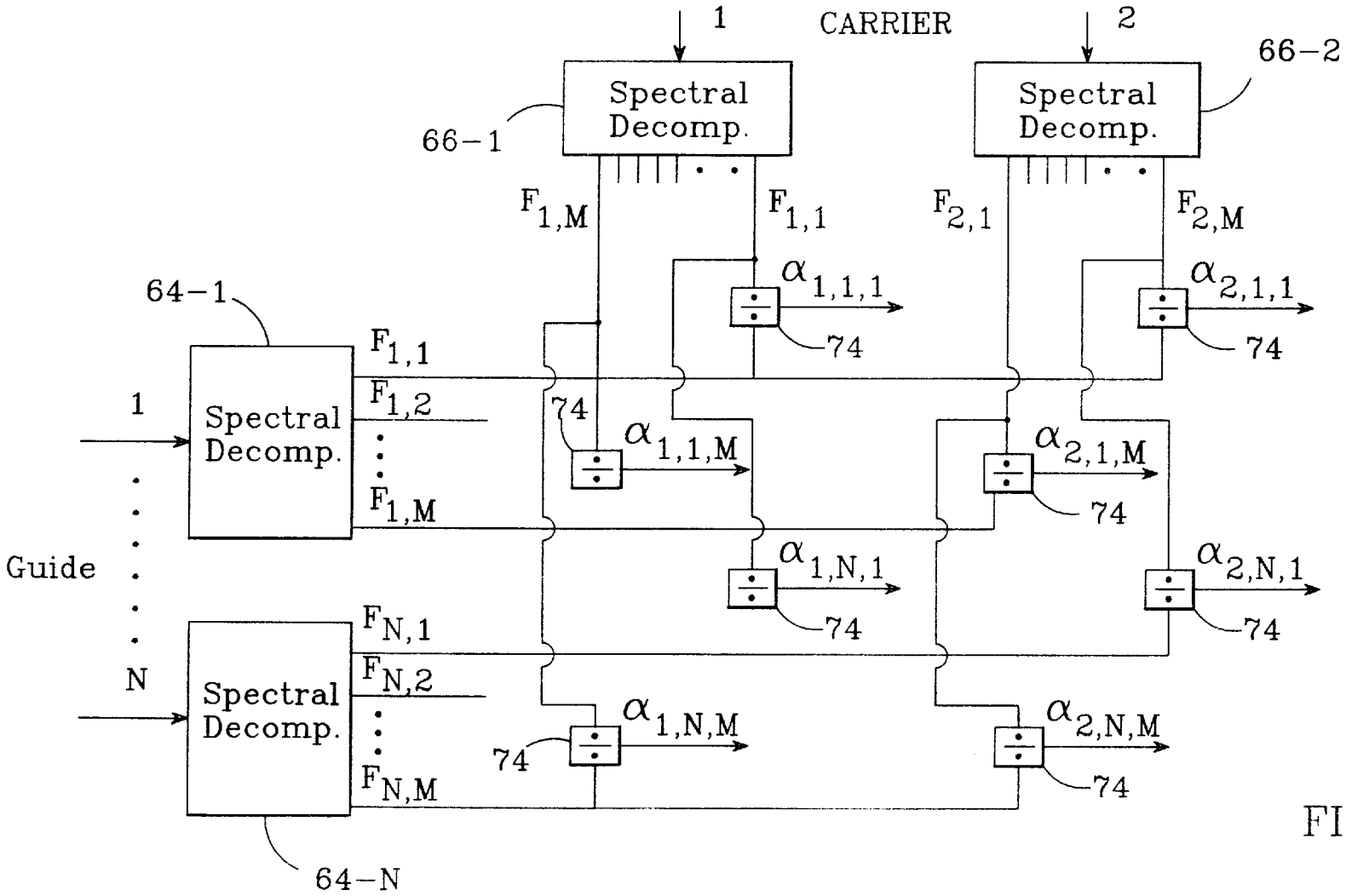
FIG. 5 is a block diagram illustrating the spectral mapping coefficient generating algorithm.

FIG. 5 illustrates in more detail the operation of encoder DSP 62 for the case of stereo input channels. As with the decoder algorithms, functions that are preferably performed by single algorithms on a multiplexed basis are illustrated as equivalent separate functions for ease of understanding. The input audio signal on the input stereo channels are spectrally decomposed by spectral decomposition algorithms 66-1 and 66-2 into respective frequency bands $F_{1,1} \ldots F_{1,M}$ and $F_{2,1} \ldots F_{2,M}$, while the guide signals on the desired N number of output channels are spectrally decomposed by spectral decomposition algorithms 64-1 through 64-N into respective frequency bands $F_{1,1} \ldots F_{1,M}$ through $F_{N,1} \ldots F_{N,M}$ that correspond to the input channel frequency bands. A set of dividers 74 (equal in number to 2×N×M) compare the signal level within each band of each input channel with the signal level within the corresponding bands of each of the output channels, by ratioing the two signal levels, to generate a set of SMCs that represent the ratios of the band-based output-to-input signal levels. Separate SMCs are obtained from each divider, and used at the decode end to map the input signals onto the output channels as described above.

Another important technique to reduce the amount of data required to be transmitted for the SMCs and to generalize the representation in a way that allows playback in a number of different formats is to not send the actual SMCs, but rather spectral component lookup address data from which the coefficients may be readily derived. In the case of the playback speakers arranged in three dimensions around the listener, only a 3-dimensional address of a given spectral component needs to be specified; this requires only three numbers. In the case of playback speakers arranged in a plane around the listener, only a 2-dimensional address of a given spectral component needs to be specified; this requires only two numbers. The translation of a 2 or 3-dimensional address into the SMCs for more or even fewer channels can be easily accomplished using a simple table lookup procedure. A conventional lookup table can be employed, or less desirably an algorithm could be entered for each different set of address data to generate the desired SMCs. For purposes of the invention an algorithm of this type is considered a form of lookup table, since it generates a unique set of coefficients for each different set of input address data.

Different addressable points in the address space would have different associated entries in the lookup table, or the SMCs may be generated by simple linear interpolation from the nearest entries in the table to conserve on table size. Formatting of the SMCs as sets of address numbers would be accomplished in the SMC formatter 64 of FIG. 4, while the lookup table at the decoder end would be embedded in the SMC formatter 6 of FIG. 1.

Figure 6:
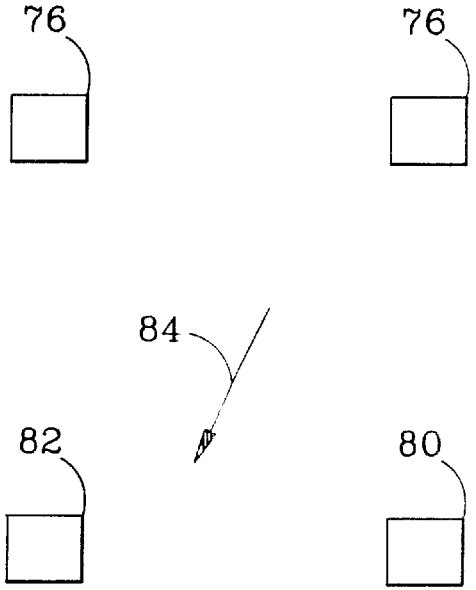
FIG. 6 is a block diagram illustrating a vector technique for representing the mapping coefficients.

The concept is illustrated in FIG. 6, in which four speakers 76, 78, 80 and 82 are all arranged in a common plane. A central vector arrow 84, which is shown pointing to a location between speakers 80 and 82 but closer to speaker 82, indicates the emphasis to be given to each of the speakers for a particular aperture time period and frequency band. Vector 84 is slightly greater than normal to a line from speaker 76, and generally points away from speaker 78. Thus, the SMCs for the decoder output for speaker 82 will be greater than for the other speakers, followed by progressively reduced SMC values for speakers 8, 76 and 78, in that order. If during the next aperture time period the output from speaker 76 is to be emphasized over the other speakers for the same frequency band, vector 84 will "point" toward speaker 76 and the SMCs for each of the speakers are adjusted accordingly, with the highest value SMCs for the band now assigned to speaker 76.

Taking the vector analogy a step further, the absolute amount of emphasis to be given to each speaker, as opposed to simply the desired direction of the emphasis, can also be given by vector 84. For example, the vector direction or orientation could be chosen to indicate the sound direction, and the vector amplitude the desired level of emphasis.

Figure 7:
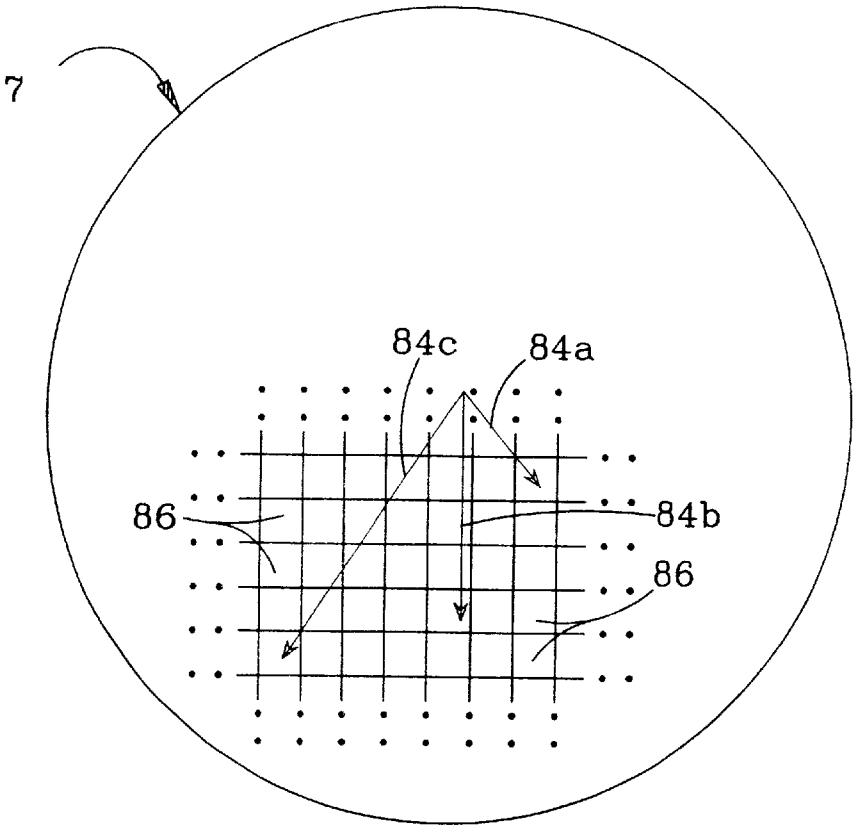
FIG. 7 is a diagram illustrating the use of the vector technique with decoder lookup tables.

FIG. 7 illustrates a mapping of different vectors 84*a*, 84*b*, 84*c* onto different lookup table addresses 86 that would be stored in the SMC formatting algorithm 7 of FIG. 1. Each address 86 stores a unique combination of SMCs. A complementary set of lookup table addresses is implemented in the encoder formatting algorithm 70 of FIG. 4 to generate the vectors from the originally calculated SMCs; these SMCs are restored from the vectors by lookup table addresses 86. Each address stores a set of coefficients that are equal in number to the number of input channels multiplied by the number of output channels. For example, with a stereo input and a five-channel output, each address would store ten SMCs, one for each input-output channel combination. Alternately, a separate lookup table could be provided for each stereo input channel, in which case each address would need to store only five SMCs. A separate vector is employed for each different frequency band, and the SMCs for a given output channel accumulated over all bands.

Since the particular address 86 used at any given time depends on both the vector amplitude and angle, it is not necessary that the vector amplitude correspond strictly to the degree of emphasis and the vector angle to the direction of emphasis. Rather, it is the unique combination of the vector amplitude and angle that determines which lookup address is used, and thus what degree of emphasis is allocated to the various output channels for each aperture period and frequency band.

The spectral address data that describes vector 84 requires only two numbers. For example, a polar coordinate system could be used in which one number describes the vector's polar angle and the other its direction. Alternately, an x,y grid coordinate system could be used. The vector concept is easily expandable to three dimensions, in which case a third number would be used for the elevation of the vector tip relative to its opposite end. Each different combination of vector amplitude and direction maps to a different address in the lookup table.

This spectral address representation is also important because it allows the input signal to be played back in various playback channel configurations by simply using different lookup tables for the SMCs for different speaker configurations. A separate 2-D or 3-D vector-to-SMC lookup table could be used to map for each different playback configuration. For example, four-speaker and six-speaker systems could be operated from the same compact disk or other audio medium, the only difference being that the four-speaker system would include a lookup table that translated the vector address data into four output channels, while the six-speaker system would include a lookup table that translated the address data into six output channels. The difference would be in the design of a single IC chip at the decoder end. In the 3-D audio case, having proper phase information in the stereo "carrier" signal is important. Other characteristics of the particular playback environment, such as the spectral response of particular speakers or environments, can also be accounted for in the "position"-to-SMC lookup tables.

The most direct way to implement the lookup table is to have each different lookup address provide the absolute values of the SMCs that relate each input channel to each output channel. Alternately, the active matrix approach of the present invention could be superimposed on a prior passive matrix approach, such as the Dolby or Rocktron techniques mentioned previously. For example, a fixed (passive) coefficient could be assigned to each input-output channel pair for each frequency band on a predetermined basis, which could be equal passive coefficients for each input-output pair. Respective active SMCs generated in accordance with the invention would then be added to the passive coefficients for the various input-output pairs.

The present invention may be used to make so-called compatible CDs, in which the CD contains a conventional stereo recording playable on conventional CD players. However, lower order bits, preferably only a fraction of the least significant bit (LSB) of the conventional digital sample words of the signal, are used to carry the SMCs for a multichannel playback. This is called a fractional LSB method of implementing the invention. ¼ of a LSB, for example, means that for every fourth signal sample the LSB is in fact an SMC data bit. At conventional stereo digital audio PCM sample rates of 48,000 samples per second this yields over 24,000 bits per second to define the SMCs (12,000 bits per second per stereo channel), while having an inaudible effect on the stereo audio signal. For a conventional 16 bit CD the audio resolution would be 15.75 bits per sample instead of 16 bits, but this is an inaudible difference. In some circumstances the other LSBs can be adjusted to spectrally shift any residual noise to hide it within a spectrally masking part of the audio spectrum; this kind of noise shaping is well known to those skilled in the art of digital signal processing. The fractional LSB method can be used to implement the invention on any digital audio medium, such as DAT (digital audio tape). A unique key code can be included in the fractional LSB data stream to identify the presence of the SMC data stream so that playback equipment incorporating the present invention would automatically respond.

Figure 8:
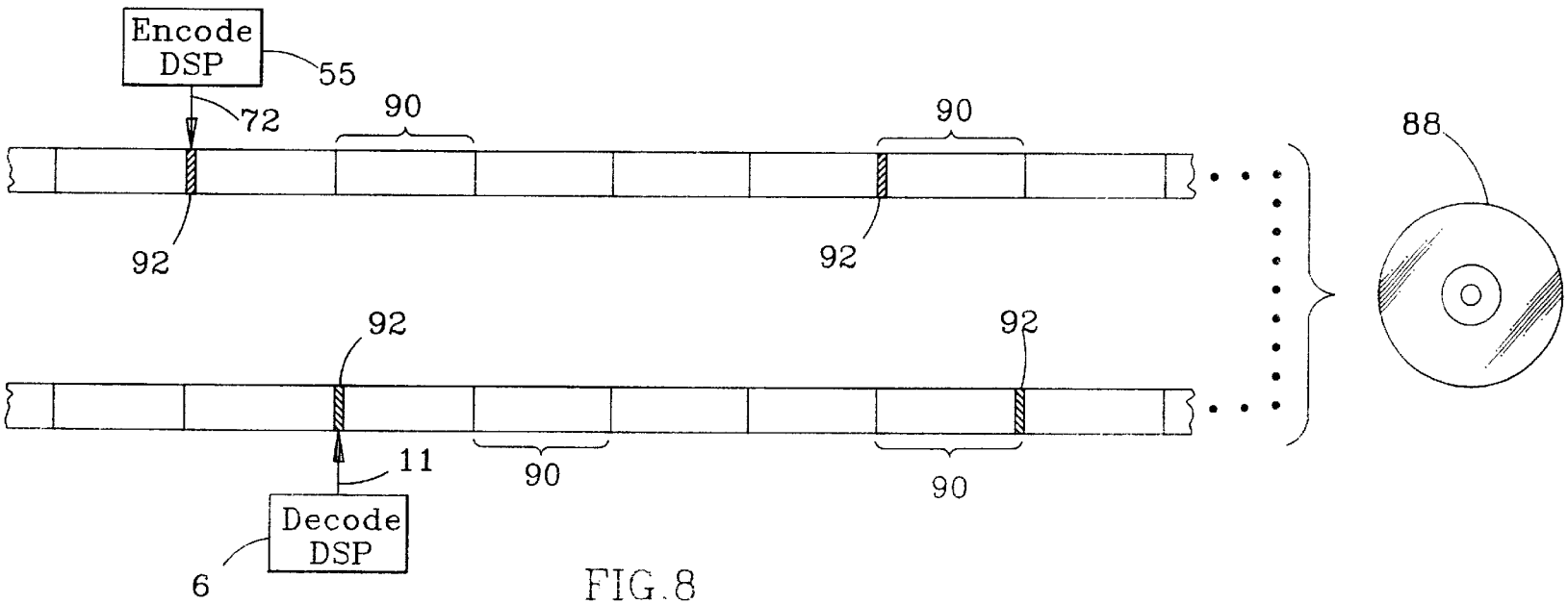
FIG. 8 is a diagram illustrating a fractional least significant bit method for encoding an audio signal with mapping coefficients.

The fractional LSB approach is illustrated in FIG. 8. Audio data from the encoder formatter 70 is transferred onto a digital audio medium, for example a compact disk 88, as multibit serial digital sample words 90, typically 16 bits per word at present. The encode DSP 55 encodes successive bits of the multibit SMCs onto the LSBs of selected sample words, preferably every fourth word, via output line 72. The sample word bits that are allocated to the SMCs are indicated by hatching and reference number 92. The SMC bits 92 are applied to the decode DSP 5 via its input 11.

The invention can also be used with an FM radio broadcast as the digital medium. In this case the SMC data is carried on a standard digital FM supplementary carrier. The FM audio signal is spectrally decomposed in the receiver and the invention implemented as described above. CDs made with the invention can be conveniently used as the source for such broadcasts, with the fractional LSB SMC data stream stripped from the CD and sent on the supplementary FM carrier with the stereo audio signal sent as the usual FM broadcast. The invention can be used in other applications such as VHS video, in which case the "carrier" stereo signal is recorded as the conventional analog or VHS HiFi audio signal and the SMC data stream is recorded in the vertical or horizontal blanking period. Alternatively, if the "carrier" audio can be recorded on the VHS HiFi channel, the SMC data stream can be encoded onto one of the conventional analog audio tracks.

In general the invention can be used with mono, stereo or multichannel audio inputs as the "carrier" signal or signals, and can map that audio onto any number of output channels. The invention can be viewed as a general purpose method for recasting an audio format in one channel configuration into another audio format with a different channel configuration. While the number of input channels will most commonly be different from the number of output channels, they could be equal as when an input two-channel stereo signal is reformatted into a two-channel binaural output signal suitable for headphones. The invention can also be used to convert an input monaural signal into an output stereo signal, or even vice versa if desired.

While several embodiments of the invention have been shown and described, numerous variations and alternate embodiments will occur to those skilled in the art. It is therefore intended that the invention be limited only in terms of the appended claims.

I claim:

1. A method of conditioning a complete audio signal that is spread among a first set of channels to be reconfigured onto a second set of channels that is different from the first set, comprising:

for each channel in said first set, establishing mapping coefficients in the form of digitally encoded signals that map audio signal levels on said channel onto respective desired signal levels for each channel in said second set such that, for each channel in said second set, the cumulative signal mapped onto said channel differs from the respective audio signals on each channel of said first set, and storing said complete audio signal on said first set of channels along with said mapping coefficient signals on a common digital medium from which both the audio signal on the first set of channels and the coefficients can later be retrieved for playback by a playback apparatus, whereby changing said mapping coefficients changes the audio playback without changing the playback apparatus.

2. The method of claim 1, wherein said mapping coefficients are established by generating said audio signal on said second set of channels with a desired distribution of said audio signal among the channels of said second set, comparing the signal on each channel in said first set with the signal on each channel in said second set, and establishing said coefficients based upon said comparisons.

3. The method of claim 1, wherein said coefficients are establishing by dividing said signal on said first set of channels into multiple spectral bands, and establishing mapping coefficients for each of said spectral bands.

4. The method of claim 3, wherein said complete audio signal is spread among said first set of channels as a compressed and spectrally decomposed signal that is divided into different spectral bands on said first set of channels, with said audio signal spectral bands matching said mapping coefficient spectral bands.

5. The method of claim 1, wherein said coefficients are established by dividing said signal on said first set of channels into overlapping temporal aperture periods, and establishing sets of coefficients for each of said aperture periods.

6. The method of claim 1, wherein said audio signal is stored on said digital medium as a series of multibit words, and said coefficients are encoded onto lower order bits of said words.

7. The method of claim 6, where said coefficients are encoded onto the least significant bit of a fractional number of said words.

8. The method of claim 1, further comprising the steps of retrieving said audio signal on said first set of channels and said coefficients from said digital medium, and applying said coefficients to said audio signal on said first set of channels to obtain the audio signal on said second set of channels.

9. The method of claim 8, wherein said coefficients are applied to said audio signal by multiplying, for each channel in said second set, the audio signal on each channel of the first set by its respective coefficient for said second set channel, and accumulating the results of said multiplications for each second set channel.

10. The method of claim 9, wherein said coefficients are established by dividing said signal on said first set of channels into multiple spectral bands for each channel and establishing said coefficients as spectral mapping coefficients (SMCs) for each of said spectral bands, and said coefficients are applied to said signal by multiplying, for each channel in said second set, the audio signal within each spectral band of each channel of the first set by its respective SMC for said second set channel.

11. The method of claim 1, wherein the mapping coefficients for each of said first set of channels define a vector that allocates a distribution of at least a portion of the signal on said channel among the channels of the second set.

12. The method of claim 11, wherein the distribution of the signals on said first set of channels among said second set of channels is partially predetermined and partially allocated by said vectors.

13. The method of claim 12, wherein the predetermined portions of the signal distributions are distributed equally among said second set of channels.

14. The method of claim 11, further comprising the steps of retrieving said audio signal on said first set of channels and said vectors from said digital medium, establishing the mapping coefficients that correspond to each of said vectors, and applying said coefficients to said audio signal on said first set of channels to obtain the audio signal on said second set of channels.

15. The method of claim 14, wherein the mapping coefficients that correspond to each of said vectors are established from at least one lookup table.

16. The method of claim 1, wherein each channel in said second set includes mapped contributions from each channel in said first set.

17. A method of reproducing on a second set of channels a complete audio signal that is spread among a first set of channels that is different from the second set, comprising:

providing said audio signal in digital format on said first set of channels along with a set of digitally formatted mapping coefficients that, for each channel in said first set, map the audio signal level of said channel onto respective channels of said second set of channels such that, for each channel in said second set, the cumulative signal mapped onto said channel differs from the respective audio signals on each channel of said first set, said audio signal and said mapping coefficients being provided on a common medium, retrieving said complete audio signal on said first set of channels and said coefficients from said common medium after they have been provided on said medium, and applying said coefficients to said complete audio signal on said first set of channels to obtain a complete audio signal on said second set of channels for playback by a playback apparatus, whereby changing said coefficients changes the audio playback without changing the playback apparatus.

18. The method of claim 17, wherein said coefficients are applied to said audio signal by multiplying, for each channel in said second set, the audio signal on each channel of the first set by its respective coefficient for said second set channel, and accumulating the results of said multiplications for each second set channel.

19. The method of claim 18, wherein said coefficients comprise spectral mapping coefficients (SMCs) for respective spectral bands of the audio signal on each channel of said first set, and said coefficients are applied to said signal by multiplying, for each channel in said second set, the audio signal within each spectral band of each channel of the first set by its respective SMC for said second set channel.

20. The method of claim 19, wherein said complete audio signal is spread among said first set of channels as a compressed and sepctrally decomposed signal that is divided into different respective spectral bands on said channels that match said SMC bands.

21. The method of claim 17, wherein the mapping coefficients for each of said first set of channels are stored on said digital medium as respective vectors that allocate a distribution of at least a portion of the signal on said channel among the channels of said second set, said coefficients are retrieving from said digital medium in the form of said vectors, and the coefficients that are applied to said audio signal on said first set of channels to obtain the audio signal on said second set of channels are derived from said vectors.

22. The method of claim 21, wherein said coefficients are derived from said vectors by storing coefficients for different vectors in a lookup table, and obtaining coefficients from the lookup table that correspond to the vectors read from said digital medium.

23. The method of claim 17, wherein each channel in said second set includes mapped contributions from each channel in said first set.

24. A method of conditioning a complete audio signal on a monaural or stereo source channels to be reconfigured into a multi-channel format of target channels different in number from said source channels, comprising:

dividing the signal on each source channel into multiple different spectral bands, establishing separate spectral mapping coefficients (SMCs) for each band of each source channel that map the signal level within their respective bands onto desired signal levels for a corresponding spectral band of each target channel such that, for each target channel, the cumulative signal mapped onto the spectral bands of said target channel differs from the respective audio signals in the corresponding spectral bands of each source channel, and storing said complete audio signal on said source channels along with said SMCs on a common digital medium from which both the audio signal on the source channels and the SMCs can later be retrieved for playback by a playback apparatus, whereby changing said SMCs changes the audio playback without changing the playback apparatus.

25. The method of claim 24, wherein said SMCs are established by generating said audio signal on said target channels with a desired distribution of said signal among said target channels, comparing the signal within each spectral band of each source channel with the signal within the corresponding spectral band of each target channel to obtain ratios between the compared signals, and establishing said SMCs based upon said ratios.

26. The method of claim 24, wherein said SMCs are established by dividing said audio signal on said source channels into overlapping temporal aperture periods, and establishing sets of SMCs for each of said aperture periods.

27. The method of claim 24, wherein said audio signal is stored on said digital medium as a series of multibit words, and said SMCs are encoded onto lower order bits of said words.

28. The method of claim 27, wherein said SMCs are encoded onto the least significant bit of a fractional number of said words.

29. The method of claim 24, further comprising the steps of retrieving said audio signal on said source channels and said SMCs from said digital medium, and applying said SMCs to said audio signal on said source channels to obtain the audio signal on said target channels.

30. The method of claim 29, wherein said SMCs are applied to said audio signal by multiplying, for each target channel, the audio signal on each source channel by its respective SMC for said target channel, and accumulating the results of said multiplications for each target channel.

31. The method of claim 24, wherein said SMCs for each source channel define a vector that allocates a distribution of at least a portion of the audio signal on said channel among said target channels.

32. The method of claim 31, wherein the distribution of the signals on said source channels among said target channels is partially predetermined and partially allocated by said vectors.

33. The method of claim 32, wherein the predetermined portions of the signal distributions are distributed equally among said target channels.

34. The method of claim 31, further comprising the steps of retrieving said audio signal on said source channels and said vectors from said digital medium, establishing the SMCs that correspond to each of said vectors, and applying said SMCs to said audio signal on said source channels to obtain the audio signal on said target channels.

35. The method of claim 34, wherein the SMCs that correspond to each of said vectors are established from at least one lookup table.

36. The method of claim 24, wherein each target channel includes mapped contributions from each source channel.

37. The method of claim 24, wherein the signal on each source channel is compressed, and said SMCs are established within spectral bands that match the spectral bands of the signal on each source channel.

38. A method of reproducing on two or more target channels a complete audio signal present on a monaural or stereo source channels, comprising:

providing said audio signal in digital format on said source channels on a digital medium, providing a set of separate spectral mapping coefficients (SMCs) on the same digital medium as said audio signal, said SMCs corresponding to different spectral bands of said audio signal and, for each respective spectral band of each source channel, mapping the signal level within that band onto desired signal levels for corresponding bands of each of said target channels such that, for each target channel, the cumulative signal mapped onto the spectral bands of said target channel differs from the respective audio signals in the corresponding spectral bands of each source channel, retrieving said complete audio signal on said source channels and said SMCs from said same medium after they have been provided on said medium, and applying said SMCs to said complete audio signal on said source channels to obtain the audio signal on said target channels for playback by a playback apparatus, whereby changing said SMCs changes the audio playback without changing the playback apparatus.

39. The method of claim 38, wherein said SMCs are applied to said audio signal by multiplying, for each target channel, the audio signal on each band of each source channel by its respective SMC for said target channel, and accumulating the results of said multiplications for each band of each target channel.

40. The method of claim 38, for SMCs for each source channel that are stored on said digital medium as respective vectors that allocate a distribution of at least a portion of the audio signal on said source channel among the target channels, wherein said SMCs are retrieving from said digital medium in the form of said vectors, and the SMCs that are applied to said audio signal on said source channels to obtain the audio signal on said target channels are derived from said vectors.

41. The method of claim 40, wherein said SMCs are derived from said vectors by storing SMCs for different vectors in at least one lookup table, and obtaining SMCs from the lookup tables that correspond to the vectors read from said digital medium.

42. The method of claim 38, wherein each target channel includes mapped contributions from each source channel.

43. The method of claim 38, wherein the signal on each source channel is compressed and spectrally decomposed into different spectral bands, and said SMCs are provided within spectral bands that match the spectral bands of the signal on each source channel.

44. An audio signal conditioning circuit for conditioning a complete audio signal that is spread among a first set of channels to be reconfigured onto a second set of channels that is different from the first set, comprising:

a mapping coefficient generating circuit that, for each channel in said first set, establishes mapping coefficients in the form of digitally encoded signals that map audio signal levels for each channel in said second set such that, for each channel in said second set, the cumulative signal mapped onto said channel differs from the respective audio signals on each channel of said first set, and a transfer circuit connected to apply said complete audio signal on said first set of channels along with said mapping coefficient signals to a common digital medium from which both the audio signal and the coefficients can later be retrieved for playback by a playback apparatus, whereby changing said mapping coefficients changes the audio playback without changing the playback apparatus.

45. The circuit of claim 44, further comprising a mixer that mixes a multitrack master audio signal into a desired distribution among the second set of channels, wherein said coefficient generating circuit includes a circuit that compares the signal on each channel in the first set with the signal on each channel in the second set to establish said coefficients.

46. The circuit of claim 44, wherein said coefficient generating circuit establishes said coefficients by dividing the signal on said first set of channels into multiple spectral bands for each channel, and establishing mapping coefficients for each of said spectral bands.

47. The circuit of claim 44, wherein said coefficient generating circuit establishes said coefficients by dividing the signal on said first set of channels into overlapping temporal aperture periods, and establishing sets of coefficients for each of said aperture periods.

48. The circuit of claim 44, wherein said transfer circuit applies said audio signal to said digital medium as a series of multibit words, with said coefficients encoded onto lower order bits of said words.

49. The circuit of claim 48, where said transfer circuit encodes said coefficients onto the least significant bit of a fractional number of said words.

50. The circuit of claim 44, further comprising a receive circuit connected to retrieving said audio signal on said first set of channels and said coefficients from said digital medium, and a decoding circuit connected to apply said coefficients to said audio signal on said first set of channels to obtain the audio signal on said second set of channels.

51. The circuit of claim 50, wherein said decoding circuit includes multipliers connected to multiply, for each channel in said second set, the audio signal on each channel of the first set by its respective coefficient for said second set channel, and accumulators connected to accumulate the results of said multiplications for each second set channel.

52. The circuit of claim 51, wherein said coefficient generating circuit establishes said coefficients by dividing said signal on said first set of channels into multiple spectral bands for each channel and establishing said coefficients as spectral mapping coefficients (SMCs) for each of said spectral bands, and said multipliers are connected to multiply, for each channel in said second set, the audio signal within each spectral band of each channel of the first set by its respective SMC for said second set channel.

53. The circuit of claim 44, wherein said coefficient generating circuit generates the coefficients for each of said first set of channels as a vector that allocates a distribution of at least a portion of the signal on said channel among the channels of the second set.

54. The circuit of claim 53, wherein said coefficient generating circuit generates said vectors so that the distribution of the signals on said first set of channels among said second set of channels is partially predetermined and partially allocated by said vectors.

55. The circuit of claim 53, further comprising a receive circuit that retrieves said audio signal on said first set of channels and said vectors from said digital medium, and a decoding circuit that establishes the mapping coefficients that correspond to each of said vectors and applies said coefficients to said audio signal on said first set of channels to obtain the audio signal on said second set of channels.

56. The circuit of claim 55, wherein said decoding circuit includes at least one lookup table that maps said vectors onto corresponding sets of mapping coefficients.

57. The circuit of claim 44, wherein each channel in said second set includes mapped contributions from each channel in said first set.

58. A circuit for reproducing on a second set of channels a complete audio signal that is spread on a common digital medium among a first set of channels different from the second set, comprising:

a receive circuit connected to retrieve from said common digital medium both said complete audio signal and a set of mapping coefficients that, for each channel in said first set, map the audio signal level of said channel onto respective channels of said second set of channels such that, for each channel in said second set, the cumulative signal mapped onto said channel differs from the respective audio signals on each channel of said first set, and a decoding circuit connected to apply said coefficients to said complete audio signal on said first set of channels to obtain the audio signal on said second set of channels for playback by a playback apparatus, whereby changing said coefficients changes the audio playback without changing the playback apparatus.

59. The circuit of claim 58, wherein said decoding circuit includes multipliers connected to multiply, for each channel in said second set, the audio signal on each channel of the first set by its respective coefficient for said second set channel, and accumulators connected to accumulate the results of said multiplications for each second set channel.

60. The circuit of claim 59, for coefficients that comprise spectral mapping coefficients (SMCs) for respective spectral bands of the audio signal on each channel of said first set, wherein said multipliers are connected to multiply, for each channel in said second set, the audio signal within each spectral band of each channel of the first set by its respective SMC for said second set channel.

61. The circuit of claim 58, for coefficients for each of said first set of channels in the form of respective vectors that allocate a distribution of at least a portion of the signal on said channel among the channels of said second set, wherein said receive circuit is connected to retrieve said coefficients in the form of said vectors, and said decoding circuit derives said coefficients from said vectors for application to said audio signal on said first set of channels.

62. The circuit of claim 61, wherein said decoding circuit includes at least one lookup table that maps said vectors onto corresponding sets of coefficients.

63. The circuit of claim 58, where each channel in said second set includes mapped contributions from each channel in said first set.

64. An audio signal conditioning circuit for conditioning a complete audio signal on a monaural or stereo source channels to be reconfigured into a multichannel format of target channels, comprising:

a spectral decomposition circuit connected to divide the signal on each source channel into multiple different spectral bands, a spectral mapping coefficient (SMC) generating circuit that, for each band of each source channel, establishes a separate SMC that maps the signal level within said band onto desired signal levels for a corresponding spectral band of each target channel such that, for each target channel, the cumulative signal mapped onto the spectral bands of said target channel differs from the respective audio signals in the corresponding spectral bands of each source channel, and a transfer circuit connected to apply said complete audio signal in said multiple different spectral bands along with said SMCs to a common digital medium from which both the audio signal and the SMCs can later be retrieved for playback by a playback apparatus, whereby changing said SMCs changes the audio playback without changing the playback apparatus.

65. The circuit of claim 64, further comprising a mixer that mixes a multitrack master audio signal into a desired distribution among said target channels, wherein said SMC generating circuit includes a circuit that compares the signal within each spectral band of each source channel with the signal within the corresponding spectral band of each target channel to obtain ratios between the compared signals, and establishes said SMCs based upon said ratios.

66. The circuit of claim 64, wherein said SMC generating circuit establishes said SMCs by dividing said audio signal on said source channels into overlapping temporal aperture periods, and establishing sets of SMCs for each of said aperture periods.

67. The circuit of claim 64, further comprising a transfer circuit connected to apply said audio signal on said source channels to a digital medium as a series of multibit words, with said SMCs encoded onto lower order bits of said words.

68. The circuit of claim 67, wherein said transfer circuit encodes said SMCs onto the least significant bit of a fractional number of said words.

69. The circuit of claim 64, further comprising a transfer circuit connected to apply said audio signal on said source channels along with said SMCs to a digital medium, a receive circuit connected to retrieve said audio signal on said source channels and said SMCs from said digital medium, and a decoding circuit connected to apply said SMCs to said audio signal on said source channels to obtain the audio signal on said target channels.

70. The circuit of claim 69, wherein said decoding circuit includes multipliers connected to multiply, for each target channel, the audio signal on each source channel by its respective SMC for said target channel, and accumulators connected to accumulate the results of said multiplications for each target channel.

71. The circuit of claim 64, wherein said SMC generating circuit generates the SMCs for each source channel as a vector that allocates a distribution of at least a portion of the audio signal on said source channel among said target channels.

72. The circuit of claim 71, wherein said SMC generating circuit generates said vectors so that the distribution of the signals on said source channels among said target channels is partially predetermined and partially allocated by said vectors.

73. The circuit of claim 71, further comprising a transfer circuit connected to apply said audio signal on said source channels along with said SMCs to a digital medium, a receive circuit that retrieves said audio signal on said source channels and said vectors from said digital medium, and a decoding circuit that establishes the SMCs that correspond to each of said vectors and applies said SMCs to said audio signal on said source channels to obtain the audio signal on said target channels.

74. The circuit of claim 73, wherein said decoding circuit includes at least one lookup table that maps said vectors onto corresponding sets of SMCs.

75. The circuit of claim 64, where each target channel includes mapped contributions from each source channel.

76. A circuit for reproducing on at least two target channels a complete audio signal having multiple different spectral bands present on a monaural or stereo source channels, comprising:

a receive circuit connected to retrieve from a common digital medium both said complete audio signal and a set of spectral mapping coefficients (SMCs) that, separately for each band of each source channel, map the signal level within that band onto respective desired signal levels for corresponding bands of each of said target channels such that, for each target channel, the cumulative signal mapped onto the spectral bands of said target channel differs from the respective audio signals in the corresponding spectral bands of each source channel, and a decoding circuit connected to apply said SMCs to said audio signal on said source channels to obtain the audio signal on said target channels for playback by a playback apparatus, whereby changing said SMCs changes the audio playback without changing the playback apparatus.

77. The circuit of claim 75, wherein said decoding circuit includes multipliers connected to multiply, for each target channel, the audio signal on each band of each source channel by its respective SMC for said target channel, and accumulators connected to accumulate the results of said multiplications for each band of each target channel.

78. The circuit of claim 76, for SMCs for each source channel in the form of respective vectors that allocate a distribution of at least a portion of the audio signal on said source channel among the target channels, wherein said receive circuit is connected to retrieve said SMCs in the form of said vectors, and said decoding circuit derives said SMCs from said vectors for application to said audio signal on said source channels.

79. The circuit of claim 78, wherein said decoding circuit includes at least one lookup table that maps said vectors onto corresponding sets of SMCs.

80. An encoded digital audio medium, comprising:

a digital audio storage medium have a first set of digital signal channels, a digitally encoded complete audio signal spread among and stored on said storage medium on said first set of channels, and for each channel in said first set, a set of mapping coefficients stored on the same storage medium as said audio signal in the form of digitally encoded signals that map audio signal levels on said channel onto respective desired signal levels for each channel in a second channel set that differs in number from said first set such that, for each channel in said second set, the cumulative signal mapped onto said channel differs from the respective audio signal stored on each channel of said first set, the audio signal on said first set of channels and said mapping coefficients being retrievable from said storage medium for later playback by a playback apparatus on said second set of channels, whereby changing said coefficients changes the audio playback without changing the playback apparatus.

81. The digital audio medium of claim 80, wherein said audio signal on said first set of channels comprises multiple spectral bands, with mapping coefficients for each of said spectral bands.

82. The digital audio medium of claim 80, wherein said audio signal on said first set of channels comprises overlapping temporal aperture periods, with sets of coefficients for each of said aperture periods.

83. The digital audio medium of claim 80, wherein said audio signal comprises a series of multibit words, and said coefficients comprise lower order bits of said words.

84. The digital audio medium of claim 83, where said coefficients comprise the least significant bit of a fractional number of said words.

85. The digital audio medium of claim 80, wherein the mapping coefficients for each of said first set of channels define a vector that allocates a distribution of at least a portion of the signal on said channel among the channels of the second set.

86. The digital audio medium of claim 85, wherein the distribution of the signals on said first set of channels among said second set of channels is partially predetermined and partially allocated by said vectors.

87. The digital audio medium of claim 86, wherein the predetermined portions of the signal distributions are distributed equally among said second set of channels.

88. The digital audio medium of claim 80, wherein each channel in said second set includes mapped contributions from each channel in said first set.

89. An encoded digital audio medium, comprising:

a digital audio storage medium, a digitally encoded complete audio signal on a monaural or stereo source channels stored on said storage medium in multiple different spectral bands, and spectral mapping coefficients (SMCs) stored on the same storage medium that, separately for each band of each source channel, map the signal level within said band onto respective desired signal levels for corresponding spectral bands of target channels that differ from said source channels such that, for each target channel, the cumulative signal mapped onto said target channel differs from the respective audio signals stored on each source channel, the audio signal on said source channels and said SMCs being retrievable from said storage medium for later playback by a playback apparatus on said target channels, whereby changing the SMCs changes the audio playback without changing the playback apparatus.

90. The digital audio medium of claim 89, wherein said audio signal has a predetermined distribution among said target channels, and said SMCs represent the ratios between the signals within each spectral band of each source channel and the predetermined signal within the corresponding spectral band of each target channel.

91. The digital audio medium of claim 89, wherein said audio signal on said source channels comprises overlapping temporal aperture periods, with sets of SMCs for each of said aperture periods.

92. The digital audio medium of claim 89, wherein said audio signal comprises a series of multibit words, and said SMCs comprise lower order bits of said words.

93. The digital audio medium of claim 92, wherein said SMCs comprise the least significant bit of a fractional number of said words.

94. The digital audio medium of claim 89, wherein said SMCs for each source channel define a vector that allocates a distribution of at least a portion of the audio signal on said channel among said target channels.

95. The digital audio medium of claim 94, wherein the distribution of the signals on said source channels among said target channels is partially predetermined and partially allocated by said vectors.

96. The digital audio medium of claim 95, wherein the predetermined portions of the signal distributions are distributed equally among said target channels.

97. The digital audio medium of claim 89, where each target channel includes mapped contributions from each source channel.

* * * * *